United States Patent [19]

Morishita et al.

[11] Patent Number: 4,585,402

[45] Date of Patent: Apr. 29, 1986

[54] SCROLL-TYPE FLUID MACHINE WITH ECCENTRIC RING DRIVE MECHANISM

[75] Inventors: Etsuo Morishita, Hyogo; Tsutomu Inaba, Wakayama; Toshiyuki Nakamura, Wakayama; Tadashi Kimura, Wakayama, all of Japan

[73] Assignee: Mitsubishi Denki Kabushiki Kaisha, Tokyo, Japan

[21] Appl. No.: 592,206

[22] Filed: Mar. 22, 1984

[30] Foreign Application Priority Data

Mar. 22, 1983 [JP] Japan ..... 58-48183

[51] Int. Cl.[4] ..... F04C 18/04; F04C 29/00

[52] U.S. Cl. ..... 418/55; 418/94

[58] Field of Search ..... 418/55, 59, 88, 94

[56] References Cited

U.S. PATENT DOCUMENTS

| | | | |
|---|---|---|---|
| 4,065,279 | 12/1977 | McCullough | 418/55 |
| 4,403,927 | 9/1983 | Butterworth et al. | 418/55 |
| 4,468,181 | 8/1984 | Sakamoto | 418/55 |

*Primary Examiner*—John J. Vrablik

*Attorney, Agent, or Firm*—Sughrue, Mion, Zinn, Macpeak, and Seas

[57] ABSTRACT

A scroll-type fluid machine, preferably, a scroll-type compressor, having a small size and improved sealing between scroll members. An orbiting scroll is interleaved with a stationary scroll. A crank mechanism is provided for causing the orbiting scroll to undergo an orbiting motion. The crank mechanism includes a crankshaft and an eccentric ring rotated in an eccentric pattern by the crankshaft. Orbital movement of the orbiting scroll is transmitted from the eccentric ring to a shaft of the orbiting scroll. The distance between the center of rotation of the crankshaft and the center of the orbiting scroll shaft is made substantially equal to the radius of orbit when the center of rotation of the crankshaft, the center of the orbiting scroll shaft, and the center of rotation of the eccentric ring are arranged along a straight line in the stated order.

12 Claims, 16 Drawing Figures

SCROLL-TYPE FLUID MACHINE WITH ECCENTRIC RING DRIVE MECHANISM

BACKGROUND OF THE INVENTION

This invention relates to a scroll-type fluid machine.

In order to facilitate an understanding of the present invention, it is helpful to describe the principles of the scroll-type fluid machine briefly.

FIGS. 1A to 1D show the fundamental components of a scroll-type compressor, which is one application of a scroll-type fluid machine, and illustrate the principles of the gas compression function thereof. In FIGS. 1A to 1D, reference numeral 1 depicts a stationary scroll, 2 an orbiting scroll, 5 a compression chamber defined between the stationary and orbiting scrolls 1 and 2, 6 a suction chamber, and 8' a discharge chamber formed in the innermost portion of an area defined between the scrolls 1 and 2. The character O depicts a center of the stationary scroll 1 and O' a fixed point on the orbiting scroll 2. The orbiting scroll 2 has the same shape as that of the stationary scroll 1 but with the opposite direction of convolution. The convolution may be in the form of an involute or a combination of involutes and arcs. The compression chamber 5 is formed between the convolutions.

In operation, the stationary scroll 1, in the form of an involuted spiral having the axis O, and the orbiting scroll 2 in the form of an oppositely involuted spiral of the same pitch as the stationary scroll 1 and having the axis O', are interleaved as shown in FIG. 1A. The orbiting scroll 2 orbits continuously about the axis of the stationary scroll through positions as shown in FIGS. 1B to 1D without changing the attitude thereof with respect to the scroll 1. With such motion of the orbiting scroll 2 with respect to the stationary scroll 1, the volume of the compression chamber 5 is periodically reduced, and a fluid, for example a gas taken into the compression chamber 5 through the suction chamber 6, is compressed, then fed to the discharge chamber 8' formed in the center portion of the stationary scroll 1, and finally discharged through a discharge hole 8 formed in a supporting plate of the stationary scroll.

The distance OO' between the points O and O', that is, the crank radius, which is maintained constant during the orbital movement of the orbiting scroll 2, can be represented by:

$$OO' = \frac{P}{2} - t,$$

where P is the distance between adjacent turns of the spiral and corresponds to the pitch thereof and t is the thickness of the wall forming the spirals.

Further structural details and details of the operation of the conventional scroll-type compressor will be described with reference to FIGS. 2 and 3.

FIG. 2 shows in cross section a scroll-type compressor used in a refrigerator or air conditioner to compress a refrigerant gas. In FIG. 2, the stationary scroll 1 is formed integrally with a base plate 1*a*, which also constitutes a portion of a cell as described below. The orbiting scroll 2 is formed integrally with and extends upwardly from the upper surface of a base plate 3. A rotary shaft 4 of the orbiting scroll 2 extends downwardly from the lower side of the base plate 3. The suction chamber 6, which is formed peripherally of the scrolls, is connected to a gas intake part 7. A discharge port 8 formed in the base plate 1*a* of the stationary scroll opens to the discharge chamber 8'. A thrust bearing 9 supports the base plate 3 of the orbiting scroll 2. The bearing 9 is supported by a bearing support 10, which is in turn fixedly supported by the stationary scroll 1 by means of bolts or the like.

An Oldham coupling 11 provides orbital movement of the orbiting scroll 2 with respect to the stationary scroll 1. An Oldham chamber 12 is formed between the base plate 3 of the orbiting scroll 2 and the bearing support 10. A return path 13 for lubricating oil formed in the bearing support 10 communicates the Oldham chamber 12 formed in the bearing support 10 with a motor chamber described later. A crankshaft 14 receives the shaft 4 of the orbiting scroll 2 eccentrically to allow the orbiting scroll 2 to orbit. A passage 15 formed eccentrically in the crankshaft 14 feeds lubricating oil to an orbital bearing 16 provided eccentrically in the crankshaft 14 which supports the shaft 4 of the orbiting scroll 2. A main bearing 17 supports an upper portion of the crankshaft 14, while a lower portion thereof is supported by a bearing 18. A motor is provided of which a stator 19 is stationary supported and a rotor 20, together with a first balancer 21, is fixedly secured to the crankshaft 14. A second balancer 22 is fixedly secured to a lower end of the rotor 20. These components are disposed together in an airtight case 23. An oil reservoir 24 is provided in a bottom portion of the case 23, and a space 25 is provided in the case 23 for components associated with the motor.

In operation, when current is supplied to the windings of the motor stator 19, the rotor 20 produces a torque, thereby rotating the crankshaft 14. Upon rotation of the crankshaft 14, the shaft 4 of the orbiting scroll 2, supported by the orbiting bearing 16 provided eccentrically of the crankshaft 14, orbits with respect to the stationary scroll 1, and thus the orbiting scroll 2 orbits under the guidance of the Oldham coupling 11 through the states shown in FIGS. 1A to 1D to compress gas as mentioned previously. That is, the gas sucked through the intake port 7 and the intake chamber 6 formed in the outer peripheral portion of the orbiting scroll 2 and introduced into the compression chamber 5 is forced inwardly with the rotation of the crankshaft 14 to be compressed and then discharged through the discharge port 8 communicated with the discharge chamber 8' where the pressure of the gas is a maximum.

Although the orbital movement of the orbiting scroll 2 due to the rotation of the crankshaft 14 tends to produce undesirable vibration of the compressor due to a mechanical mass unbalance, the first balancer 21 and the second balancer 22 provide static and dynamic balances about the crankshaft 14 so that the compressor operates without abnormal vibration.

FIGS. 3A and 3D show portions of the compressor in FIG. 2 in more detail. Specifically, FIG. 3A shows a vertical cross-sectional view of a portion including the stationary scroll 1, the orbiting scroll 2, the shaft 4 of the orbiting scroll, the crankshaft 14 and the support member 10, wherein the shaft 4 is urged to one side of the orbiting bearing 16 due to the centrifugal force of the orbiting scroll 2, including the base plate 3. FIG. 3B is cross-sectional view taken along a line IIIB—IIIB in FIG. 3A. In FIG. 3B, $O_1$ is an axis of the main bearing 17, $O_2$ is an axis (rotational center) of the crankshaft 14, $O_3$ is the axis of the orbiting bearing 16, and $O_4$ is the axis (center) of the shaft 4 of the orbiting scroll member.

Further in FIG. 3B, $F_c$ represents the centifugal force (radial load) produced by the orbiting scroll 2 and the base plate 3, r the eccentricity of the orbiting bearing 16 relative to the crankshaft 14, $d_1$ the bearing gap of the orbiting bearing 16, $d_2$ the bearing gap of the main bearing 17, B is the width of a groove between adjacent turns of the spiral arm of the stationary scroll 1, D the actual orbiting distance of the orbiting scroll 2, $t_1$ the thickness of the wall of the orbiting scroll 2, and C and $C_1$ radial gaps between turns of the stationary scroll 1 and the orbiting scroll 2. Generally $C=C_1$.

In the conventional scroll-type compressor as described above, the orbiting distance D of the orbiting scroll 2 can be represented as follows:

$$\begin{aligned} D &= 2(r + d_1/2 + d_2/2) + t_1 \\ &= 2r + t_1 + d_1 + d_2. \end{aligned} \quad (1)$$

Therefore, the radial gap C between the turns of the stationary scroll 1 and the orbiting scroll 2 is:

$$\begin{aligned} C &= (B - D)/2 \\ &= (B - (2r + t_1 + d_1 + d_2))/2 \\ &= ((B - 2r - t_1) - (d_1 + d_2))/2. \end{aligned} \quad (2)$$

In the conventional scroll-type compressor, the term $(B-2r-t_1)$ in equation (2) is larger than $(d_1+d_2)$, and therefore the radial gap C is always present between the stationary scroll 1 and the orbiting scroll 2. In the normal operation of the compressor, however, in addition to the centrifugal force $F_c$, a gas compression load $F_g$, which acts orthogonal to the centrifugal force $F_c$, acts on the shaft 4 of the orbiting scroll 2 as shown in FIG. 4, and therefore a composite force F of the forces $F_c$ and $F_g$ acts on the shaft 4 in the indicated direction. Accordingly, the radial gap C' between the turns of the stationary and orbiting scrolls 1 and 2 is larger than the radial gap C with only the centrifugal force $F_c$ acting thereon.

With the presence of the radial gap C or C', there can be no contact between the stationary and orbiting scrolls 1 and 2 during the operation of the scroll compressor, and thus there is no problem of abrasion of side surfaces of the scroll walls. However, it is very difficult to seal the radial gap of the compression chamber, and hence there is a strong possibility of gas leakage from the compression chamber 5 through the radial gaps C and C' to the intake side. If gas in the compression chamber 5 leaks to the upstream side, the amount of gas finally discharged through the discharge post 8 is reduced, thereby reducing the volumetric efficiency of the compressor. Further, since the leaked gas has to be compressed again, the power consumption of the motor increases and the coefficient of performance is lowered.

In order to resolve these problems, it may be effective to set the term $(d_1+d_2)$ in equation (2) larger than the term $(B-2r-t)$ to thereby improve the sealing of the radial gaps. In such an approach, however, it is necessary to make both the bearing gaps $d_1$ and $d_2$ large enough to make $(d_1+d_2)$ always larger than $(B-2r-t)$ at any angular position of the crankshaft. However, there are unavoidable variations of the value $(B-2r-t)$ due to manufacturing variations in the groove width B, eccentricity r and wall thickness $t_1$. There are, of course, optimum values of the bearing gaps to provide a sufficient lubricating effect, which is a fundamental necessity, and if the bearing gaps are made larger than the optimum values, the lubricating functions of the bearing may be significantly lowered. Therefore, the manufacturing tolerances of the groove width B, the eccentricity r and the wall thickness $t_1$ must be very tight. Further, if the positions of the center O of the stationary scroll 1 and the axis $O_1$ of the main bearing 17 are changed for some reason, in some cases, one of them may become quite large, causing $C-C_1$ to be not always zero, even if $d_1$ and $d_2$ are set as mentioned previously. Therefore, the positional accuracy of the stationary scroll 1 with respect to the axis $O_1$ of the main bearing 17 must be very high.

U.S. Pat. No. 3,924,977 to McCullough discloses an improved radial sealing mechanism in which the orbiting scroll is linked to a driving mechanism through a radially compliant mechanical linkage, which also incorporates means for counteracting at least a fraction of the centrifugal force exerted by the orbiting of the orbiting scroll. The radially compliant mechanical linkage can take one of several forms, among which a typical linkage includes a ball bearing mounted on the shaft of the orbiting scroll and has the outer periphery of the ball bearing connected to a crank mechanism through a swinging linkage or a sliding-block linkage, each associated with a plurality of springs. Both the swinging linkage and sliding-block linkage are complicated, relatively space consuming in structure, and require a considerable number of parts, causing the compressor to be expensive and bulky.

A simpler and more inexpensive structure to achieve improved radial sealing is shown in Japanese laid-open patent application No. 129791/1981. In this structure, a balance weight having a bushing is provided. The bushing is engaged through an eccentric swinging pin connected with a crankshaft. The balance weight counteracts the centrifugal force of the orbiting scroll and the bushing functions to utilize a component of a compression load to provide a force which urges together the orbiting scroll and stationary scroll, thereby providing improved radial sealing. In the latter structure, however, the balance weight counteracting the centrifugal force of the orbiting scroll is indispensable, which requires a large space behind the orbiting scroll, leading to a difficulty in arranging a thrust bearing for the crankshaft.

SUMMARY OF THE INVENTION

The present invention was made in view of the above-mentioned problems inherent to conventional scroll-type fluid machines.

Accordingly, the present invention provides a scroll-type fluid machine in which a crank mechanism for providing orbital movement of an orbiting scroll includes a crankshaft and an eccentric ring capable of rotating about the crankshaft. A shaft of the orbiting scroll is orbited through the eccentric ring. In accordance with the invention, when the center of rotation of the crankshaft, the center of the shaft of the orbiting scroll and the center of rotation of the eccentric ring fall along a straight line in the stated order, the distance between the center of rotation of the crankshaft and the center of the shaft of the orbiting scroll is substantially equal to the radius of orbit. With this arrangement the centrifugal force due to the rotation of the orbiting scroll does not substantially influence the contact force between the orbiting scroll and the stationary scroll. Also, the actual orbiting width D of the orbiting scroll can be varied, resulting in a realization of good radial sealing of the machine, and hence an improvement in the volumetric efficiency and the coefficient of performance of the machine.

BRIEF DESCRIPTION OF THE DRAWINGS

FIGS. 5A to 7 show main portions of a preferred embodiment of a compressor of the present invention of which FIG. 5A is a cross section of a crankshaft and an orbiting scroll shaft when fitted, FIG. 6 is a oblique view of the crankshaft and an eccentric ring when dissassembled, and FIG. 7 is an oblique view of the crankshaft and the orbiting scroll shaft when dissassembled;

DESCRIPTION OF THE PREFERRED EMBODIMENTS

Figure 1A:
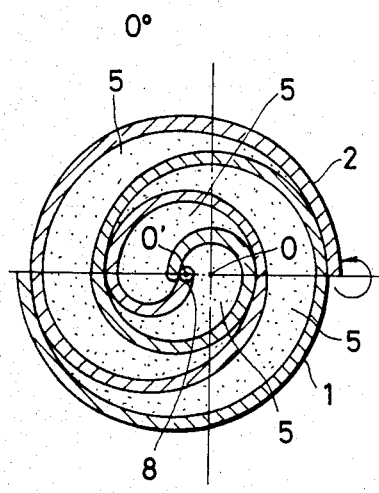
PRIOR ART FIG. 1A
FIGS. 1A to 1D show a cross section of a scroll-type compressor in various operational positions and are used to explain the operating principles thereof.
Figure 1D:
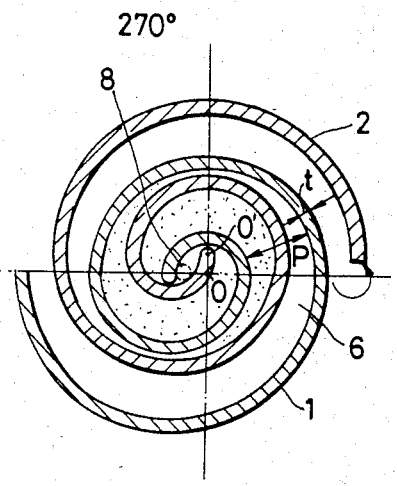
Figure 1B:
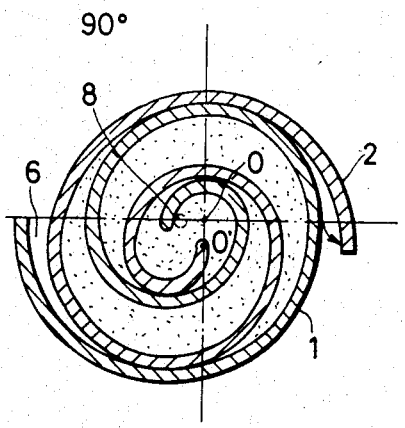
Figure 1C:
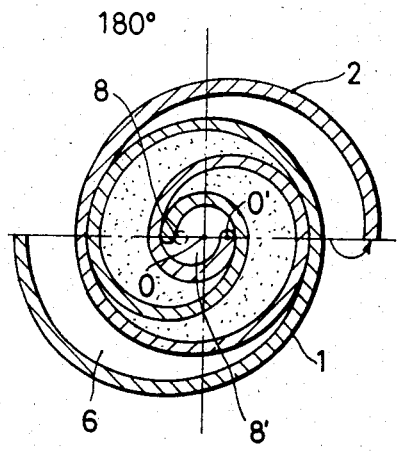
Figure 2:
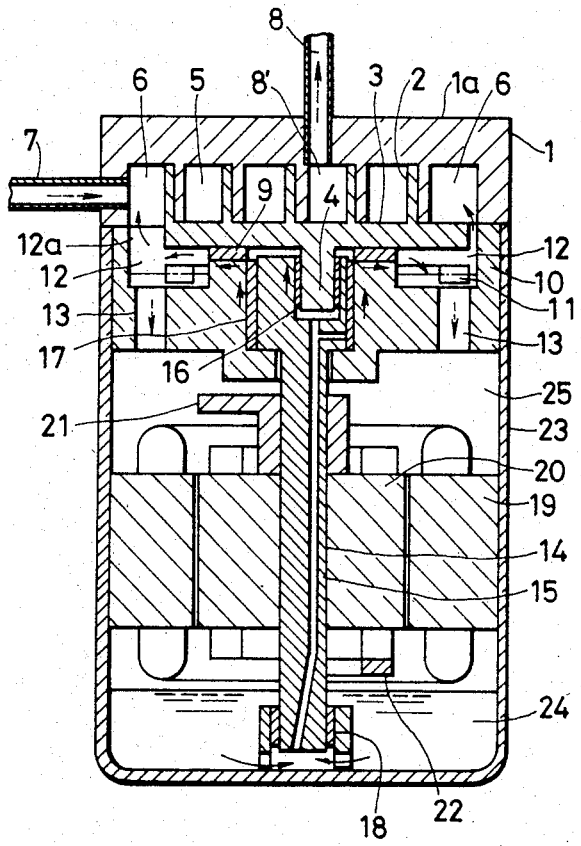
FIG. 2 PRIOR ART
FIG. 2 is a cross-sectional view of a conventional scroll-type compressor.
Figure 3B:
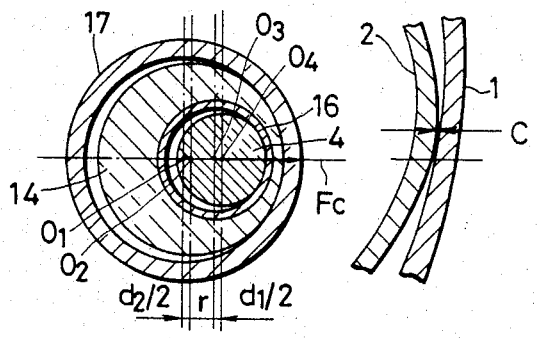
FIG. 3B PRIOR ART
FIG. 3B is a cross-sectional view taken along a line IIIB—IIIB in FIG. 3A.
Figure 3A:
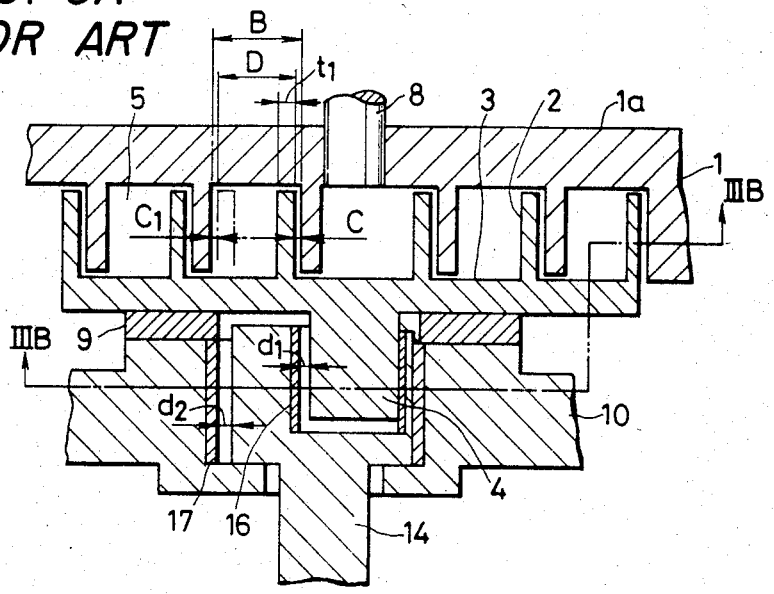
FIG. 3A PRIOR ART
FIG. 3A is an enlarged cross-sectional view of a portion of the compressor in FIG. 2 in a first state.
Figure 4:
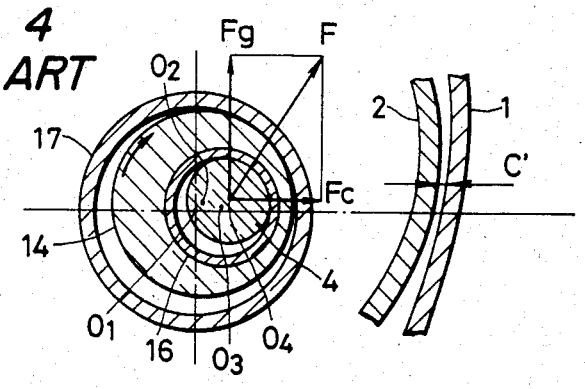
FIG. 4 PRIOR ART
FIG. 4 is a view similar to FIG. 3B with the compressor being in another state.
Figure 5A:
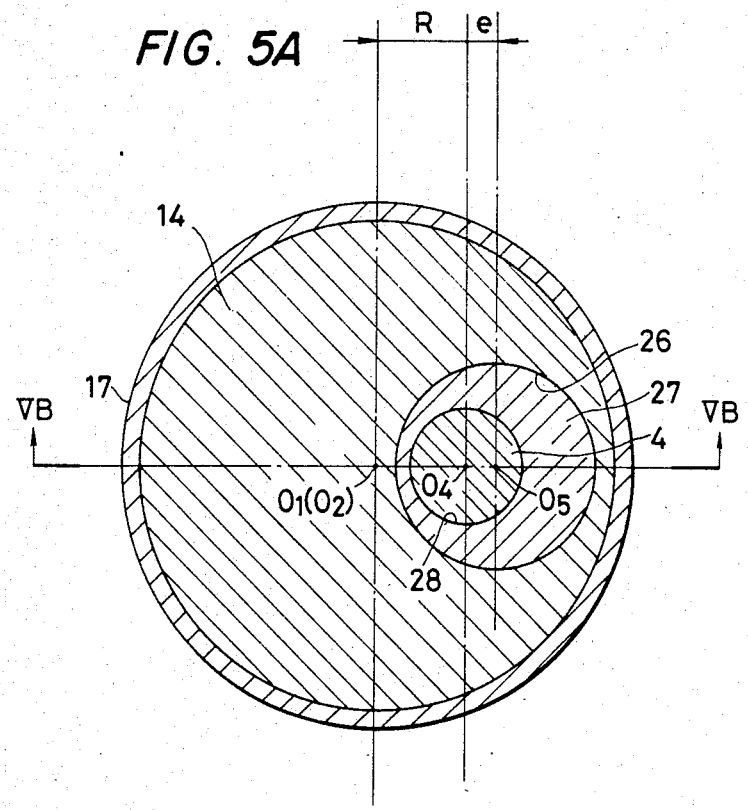
Figure 5B:
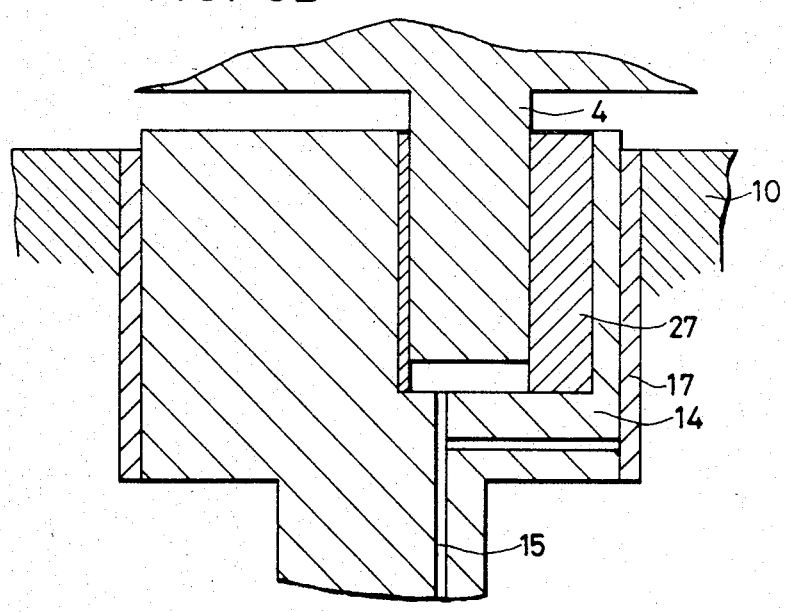
FIG. 5B is a vertical cross section taken along a line VB—VB in FIG. 5A.
Figure 6:
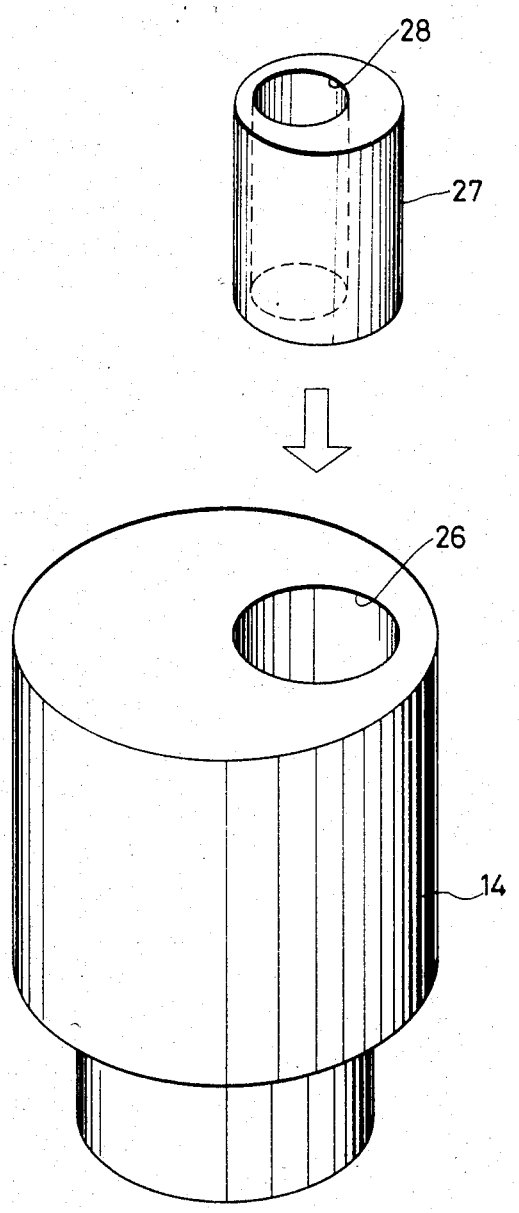
Figure 7:
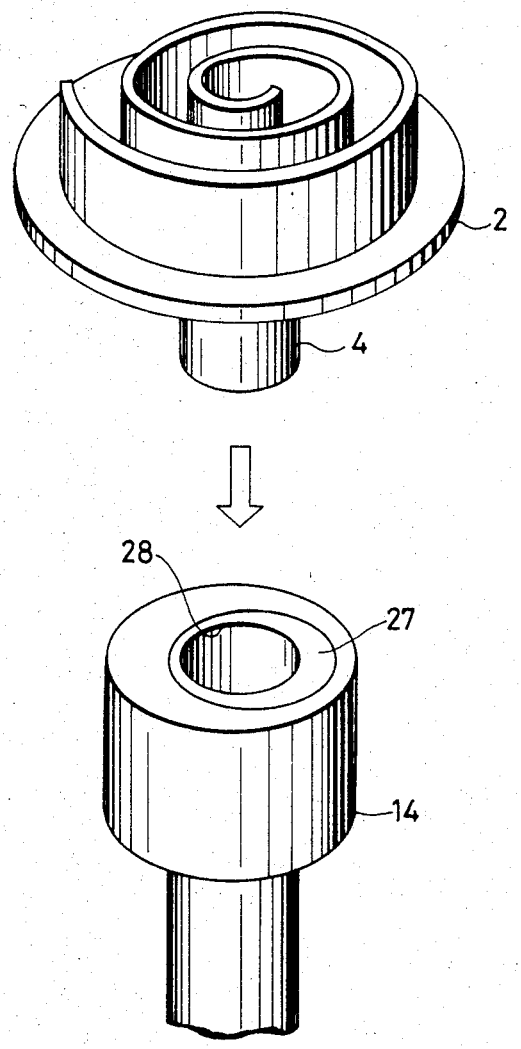

FIGS. 5A to 7, reference numeral 26 designates an eccentric hole formed in the crankshaft 14 with a predetermined eccentricity with respect to the center of rotation of the crankshaft 14. An eccentric ring 27 made of a bearing material is fitted as shown in FIG. 6. The eccentric ring 27 can rotate with respect to the crankshaft 14. An orbiting bearing 28, fitted into an eccentric hole formed in the eccentric ring 27 with a predetermined eccentricity with respect to the center of rotation $O_5$ of the ring 27, supports the shaft 4 of the orbiting scroll 2 as shown in FIG. 7.

In FIG. 5A, an axis (center) $O_1$ of the main bearing 17 lies at approximately the center of rotation $O_2$ of the crankshaft 14. The center of the orbiting bearing 28 (and hence the center of rotation of the shaft 4 of the orbiting scroll 2) and the center of rotation of the eccentric ring 27 and (and hence the center of the eccentric hole 26) are designated by $O_4$ and $O_5$, respectively. The distance between $O_1$ (or $O_2$) and $O_4$, namely, the length corresponding to the radius of orbit of the shaft 4 of the orbiting scroll 2, and the distance between $O_4$ and $O_5$, are indicated by R and e, respectively.

In the structure of FIGS. 5A and 5B, gaps may exist between the main bearing 7 and the crankshaft 14, between the eccentric hole 26 and the eccentric rings 27, and between the orbiting bearing 28 and the shaft 4 of the orbiting scroll 2. However, these gaps are not important in understanding the present invention and are omitted from these figures. Further, the radius of orbit R actually includes halves of the respective bearing gaps, which are very small and negligible.

The eccentric ring 27 is rotatable about the center $O_5$ within the eccentric hole 26. The distance between $O_2$ and $O_4$, which is substantially equal to R, is changed cyclically with the rotation of the eccentric ring 27 about the point $O_5$.

An important feature of this embodiment is that, when the center of rotation $O_2$ of the crankshaft 14, the center $O_4$ of the orbiting scroll 2 and the center of rotation $O_5$ of the eccentric ring 27 are arranged in that order along a straight line, the distance between $O_2$ and $O_4$ is substantially equal to the crank radius.

Figure 8:
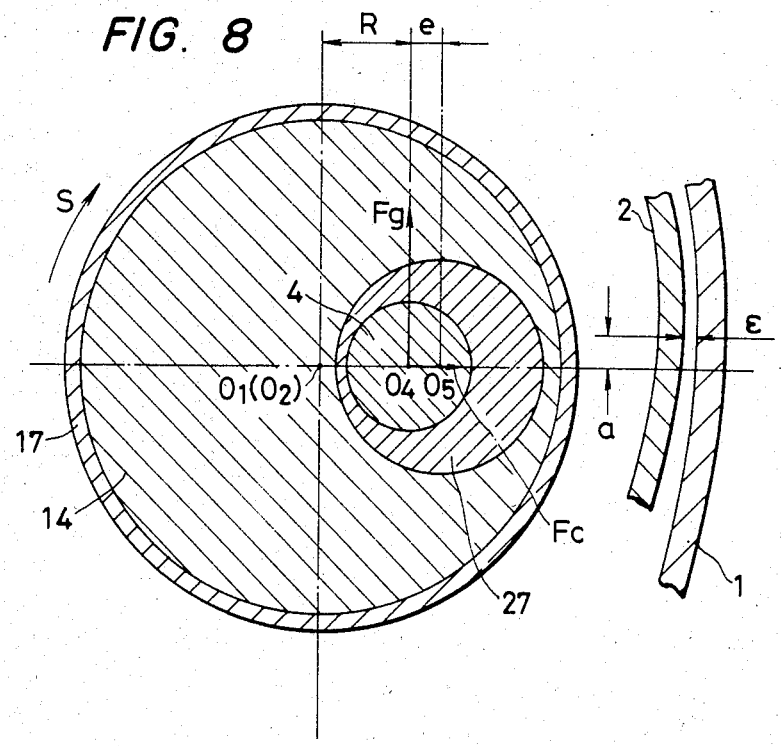
FIGS. 8 and 9 illustrate the mode of radial sealing according to the present invention.

In the operation of the compressor thus constructed, the compression of gas is performed according to the principles illustrated in FIGS. 1A to 1D. The load arising due to gas compression is transmitted from the shaft 4 of the orbiting scroll 2 to the eccentric ring 27, with the loading conditions being as shown in FIG. 8. The load includes two components, one being a radial load, mainly the centrifugal force $F_c$, and the other being a gas compression load $F_g$ in a direction orthogonal to the radial load $F_c$. These load components act on the center $O_4$ of the shaft 4 of the orbiting scroll 2 as shown in FIG. 8.

Since the center of rotation of the eccentric ring 27 is $O_5$, the gas compression load component $F_g$ produces a moment about $O_5$, which causes the eccentric ring 27 to be rotated about $O_5$. When the eccentric ring 27 rotates about $O_5$, the distance between $O_2$ and $O_4$, which corresponds to the radius of orbit, increases. With the increase of the distance between $O_2$ and $O_4$, a small gap C is formed between a turn of the stationary scroll 1 and a turn of the orbiting scroll member 2 adjacent the turn of the stationary scroll 1. The width of the gap is typically several decades of microns.

If the scrolls have an involuted shape, positions at which the radial gap between the spirals shown in FIG. 8 is a minimum are separated from a line on which the load component $F_c$ acts by a distance corresponding to a radius a of an involuted base circle and lie on a straight line parallel to the direction of the component $F_c$.

Figure 9:
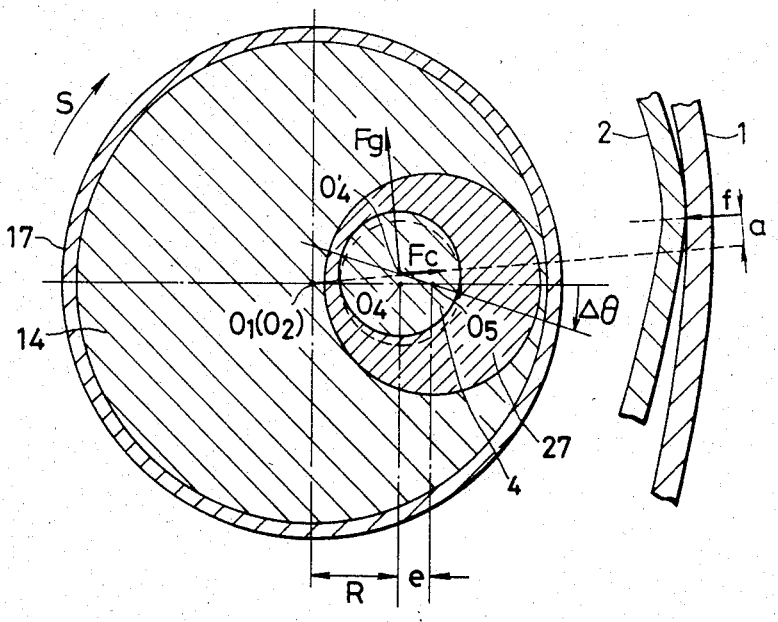

FIG. 9 shows the eccentric ring 27 when it is rotated by a small angle of $\Delta\theta$ due to the gas compression load component $F_g$. In this state, the stationary scroll 1 is in contact with the orbiting scroll 2. Due to the rotation of the ring 27 by the angle of $\Delta\theta$, the center of the shaft 4 of the orbiting scroll 2 moves slightly from $O_4$ to $O_4'$, making $O_2O_4' > O_2O_4$.

As can be seen in FIG. 9, due to a moment produced by the component $F_g$ about the center of rotation $O_5$ of the eccentric ring 27, the length $O_2O_4$ corresponding to the radius of orbit increases to $O_2O_4'$ (actual crank radius), and the wall of the orbiting scroll 2 contacts the wall of the stationary scroll 1.

In the state shown in FIG. 9, the moments about $O_5$ are substantially balanced because the angle $\Delta\theta$ is small. It is physically shown that the orbiting scroll 2 contacts the stationary scroll 1 at least at two points on either side of $O_4$. That is:

$$F_g \cdot e = f \cdot a \cdot \times 2$$

Therefore, the contact force f between the orbiting scroll 2 and the stationary scroll 1 is given by:

$$f = \frac{e}{2a} \cdot F_g.$$

The load component $F_c$ is also capable of producing a moment about $O_5$. However, this moment is negligible when $\Delta\theta$ is small. Hence, due to the small value of $\Delta\theta$, it is possible to make the orbiting scroll 2 contact the stationary scroll 1 as shown in FIG. 9.

Therefore, the contact force f is not substantially influenced by the centrifugal force $F_c$ and is basically a function of only the gas compression load component $F_g$. When the rotational speed of the compressor is increased, the centrifugal force $F_c$ increases correspondingly. However, the gas compression load component $F_g$ does not change since it depends only upon the compression conditions. Therefore, the contact force f is substantially constant, even when the rotational speed of the compressor is changed.

The radial gap between the orbiting scroll 2 and the stationary scroll 1 is sealed by utilizing the force acting orthogonally of the centrifugal force (the gas compression load component) during the operation of the compressor with substantially no influence of the latter force. Therefore, gas leakage from the compression chamber 5 is minimized, resulting in an increase of the volumetric efficiency. The power consumption of the motor also is reduced because recompression of leaked gas is not needed. Thus, the coefficient of performance of the compressor is improved. Since the radius of orbit can be varied, it is possible to tolerate greater variations in the machining and assembly of the various components of the compressor. That is, it is not always necessary to machine the groove of width B, the eccentric hole, the wall of thickness t, etc. with high precision, and there is no need of highly precise assembly techniques.

Further, as mentioned previously, the eccentric ring 27 is made of bearing material. Therefore, there is no need of providing bearing material parts inside the surfaces of the eccentric hole 26 and the orbiting bearing 28, making the construction of the compressor of the invention much simpler than the conventional machine.

As an example, if the length $O_2O_4$ corresponding to the radius of orbit is 5 mm and e=1 mm, an actual radius $O_2O_4'$ becomes larger than $O_2O_4$ by $\epsilon$, where $\epsilon$ is on the order of 50 $\mu$m. However, in order to facilitate the assembly of the machine, it is sufficient for $\epsilon$ to be about 0.1 mm at the maximum point. In such a case, there may be some slight influence of the centrifugal force; however it is negligible as a practical matter.

Figure 10:
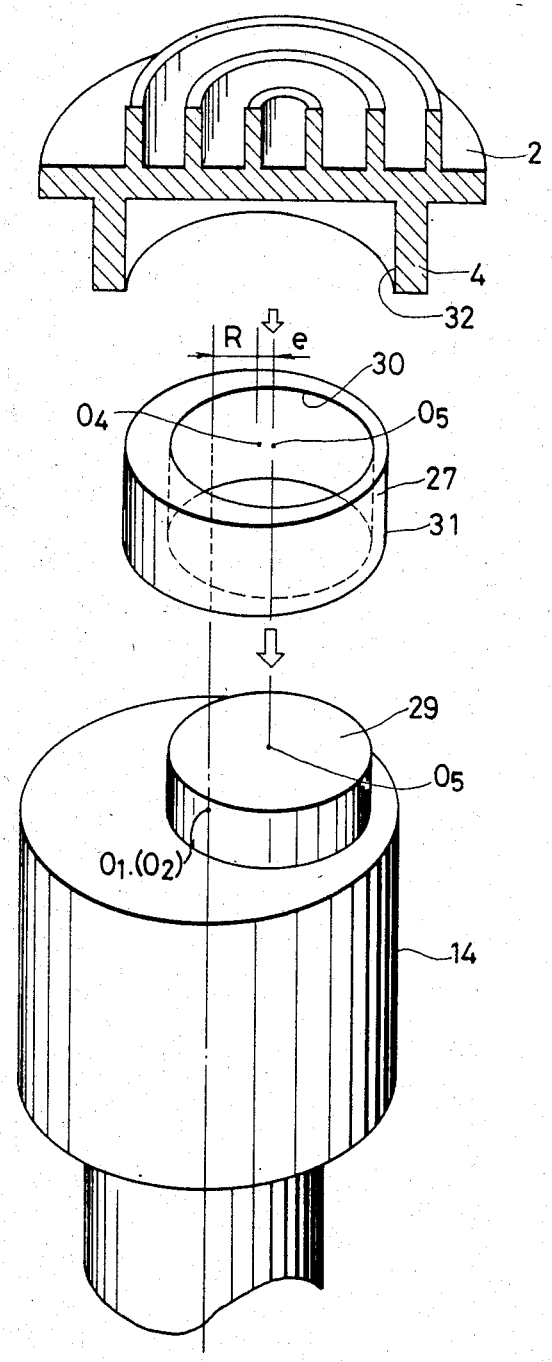
FIGS. 10 and 11 show other embodiments of the present invention.

In the embodiment described hereinbefore, the eccentric ring 27 is fitted in the eccentric hole 26. Instead, however, it is possible to form an eccentric protrusion 29 on the crankshaft 14 which is fitted into an eccentric hole 30 formed in the eccentric ring 27, which is in turn inserted into an axial hole 32 formed in the shaft 4 of the orbiting scroll 2, with the outer periphery 31 of the eccentric ring 27 being in sliding contact with an inner wall of the hole 32, as shown in FIG. 10.

Figure 11:
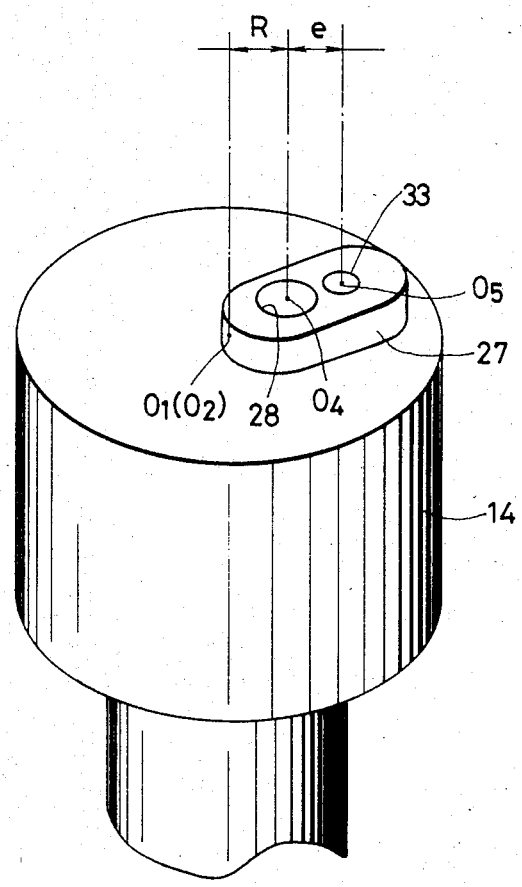

Another embodiment is shown in FIG. 11 in which a protrusion 33 is formed eccentrically on the end of crankshaft 14 on which an eccentric lobe 27 is rotatably fitted, and the orbiting bearing 28 receives the shaft 4 of the orbiting scroll 2. In the embodiment shown in either FIG. 10 or FIG. 11, the distance between the center of rotation $O_2$ of the crankshaft 14 and the center $O_4$ of the orbiting scroll shaft 4 is made substantially equal to the radius of orbit.

As described hereinbefore, the present invention resides in a scroll-type fluid machine in which the crank mechanism for providing orbital movement of the orbiting scroll includes the crankshaft and the eccentric ring capable of rotating about the crankshaft, the shaft of the orbiting scroll being orbited through the eccentric ring. When the center of rotation of the crankshaft, the center of the orbiting scroll shaft and the center of rotation of the eccentric ring are arranged along a straight line in the stated order, the distance betwen the center of rotation of the crankshaft and the center of the orbiting scroll shaft is made substantially equal to the radius of orbit. Accordingly, the radial force, which is mainly the centrifugal force due to the rotation of the orbiting scroll, is minimized without the need for a balance weight and/or springs associated with the orbiting scroll, resulting in improved radial sealing of the machine and hence improvements of the volumetric efficiency and the coefficient of performance of the machine.

Furthermore according to the invention, because the machine is insensitive to radial forces, it is particularly suitable to be applied to a scroll-type fluid machine which is operated at a variable speed.

We claim:

1. A scroll-type compressor comprising: a stationary involuted scroll member; an orbiting involuted scroll member interleaved with said stationary scroll member for compressing a volume of fluid taken in when said orbiting scroll member is orbited with respect to said stationary scroll member; an orbiting scroll shaft rigidly coupled to one end of said orbiting scroll member; and a crank mechanism and a bearing for supporting said crank mechanism comprising a crankshaft and an eccentric member operably associated with and rotatable with respect to said crankshaft, said orbiting scroll shaft operably associated with said eccentric member wherein, orbital movement of said orbiting scroll shaft is provided by said crankshaft through said eccentric member, a distance between a center of rotation of said crankshaft and a center of said orbiting scroll shaft being substantially equal to a radius of orbit when said center of rotation of said crankshaft, said center of said orbiting scroll shaft and a center of rotation of said eccentric member are arranged along a straight line in the stated order.

2. The scroll-type compressor as claimed in claim 1, wherein said eccentric member is in the form of a ring and is rotatably fitted in an eccentric hole formed eccentrically in said crankshaft, and said orbiting scroll shaft is fitted in an orbiting bearing formed eccentrically in said eccentric ring.

3. The scroll-type compressor as claimed in claim 2, wherein said eccentric ring is made of a bearing material.

4. The scroll-type compressor as claimed in claim 1, wherein an eccentric protrusion is formed eccentrically on said crankshaft and fitted in an eccentric hole formed eccentrically in said eccentric member, and said eccentric member received in an axial hole formed in the shaft of said orbiting scroll with an outer peripheral surface of said eccentric member being in contact with an inside wall of said axial hole.

5. The scroll type compressor as claimed in claim 1, wherein said eccentric member takes the form of a lobe supported rotatably by a protrusion formed in an end face of said crankshaft, in the side of said orbiting scroll at a predetermined distance from said rotation center of said crankshaft, said lobe being formed with a bearing having a center at a distance from said center of said protrusion, the last distance being similar than said predetermined distance, said bearing rotatably supporting said shaft of such orbiting scroll.

6. The scroll type compressor as claimed in claim 1, wherein said crankshaft has an end portion on which said orbiting scroll is disposed and a second end portion on which a rotor of a motor for driving said crankshaft is formed.

7. The scroll type compressor as claimed in claim 1, wherein said crankshaft is supported by a main bearing arranged to surround said orbiting scroll shaft through said crankshaft.

8. The scroll type compressor as claimed in claim 1, wherein said crankshaft has an end portion on which said orbiting scroll is disposed, said crankshaft being supported by a ring shaped main bearing arranged so that it surrounds said orbiting scroll shaft through said crankshaft said orbiting scroll being supported by a thrust bearing.

9. The scroll type compressor as claimed in claim 8, wherein said main bearing and said thrust bearing are mounted on a common bearing support.

10. The scroll type compressor as claimed in claim 6, wherein said crankshaft is formed therein with a vertically extending oil passage having a lower end opened to an oil in an oil reservoir, for supplying oil from an upper end to a sliding portion between said orbiting scroll shaft and said eccentric member and a sliding portion between said eccentric member and said crankshaft.

11. A scroll-type compressor comprising: a stationary involuted scroll member; an orbiting involuted scroll member interleaved with said first scroll member for compressing a volume of fluid taken in when said second scroll member is orbited with respect to said first scroll member; an orbiting scroll shaft rigidly coupled to one end of said second scroll member; and a crank mechanism and a bearing for supporting said crank mechanism, said crank mechanism comprising a crankshaft and an eccentric member operably associated with and rotatable with respect to said crankshaft, said orbiting scroll shaft operably associated with said eccentric member wherein, orbital movement of said orbiting scroll shaft is provided by said crankshaft through said eccentric member, a distance between a center of rotation of said crankshaft and a center of said orbiting scroll shaft being substantially equal to a radius of orbit when said center of rotation of said crankshaft, said center of said orbiting scroll shaft and a center of rotation of said eccentric member are arranged along a straight line in the stated order;

wherein said eccentric member is in the form of a ring and is rotatably fitted in an eccentric hole formed eccentrically in said crankshaft, and said orbiting scroll shaft is fitted in an orbiting bearing formed eccentrically in said eccentric ring.

12. The scroll-type compressor as claimed in claim 11, wherein said eccentric ring is made of a bearing material.

* * * * *